US005137612A

United States Patent [19]

Romine et al.

[11] Patent Number: 5,137,612

[45] Date of Patent: Aug. 11, 1992

[54] BONDED BUSBAR FOR DIAPHRAGM CELL CATHODE

[75] Inventors: Richard L. Romine, Concord; Robert B. Kubinski, Parma; L. Calvert Curlin, Painesville; James W. Pyle, Mentor, all of Ohio

[73] Assignee: OxyTech Systems, Inc., Chardon, Ohio

[21] Appl. No.: 552,731

[22] Filed: Jul. 13, 1990

[51] Int. Cl.[5] ..... C25B 11/02; C25B 9/04

[52] U.S. Cl. ..... 204/279; 204/274; 204/242

[58] Field of Search ..... 204/258, 284, 286, 262, 204/263, 279, 266

[56] References Cited

U.S. PATENT DOCUMENTS

| | | | |
|---|---|---|---|
| 2,865,834 | 12/1958 | Ross | 204/266 |
| 3,432,422 | 3/1969 | Currey | 204/279 |
| 3,778,680 | 12/1973 | Vaneerden | 361/382 |
| 3,783,122 | 1/1974 | Sato et al. | 204/279 |
| 3,859,196 | 1/1975 | Ruthel et al. | 204/278 |
| 3,904,504 | 9/1975 | Ruthel et al. | 204/286 |
| 4,178,225 | 12/1979 | Ruthel et al. | 204/279 |

*Primary Examiner*—John Niebling
*Assistant Examiner*—Kishor Mayekar
*Attorney, Agent, or Firm*—John J. Freer

[57] ABSTRACT

In a sidewall-enclosed electrolytic cell, such as for the electrolysis of brine to form chloralkali product, the cell can have at least one cathode sidewall. There is now provided an at least substantially wall-sized, planar busbar that is interface bonded to the cathode sidewall. The interface bonded, wall-sized busbar plus sidewall thereby at least substantially serve as a wall unit for the electrolytic cell. The wall-sized busbar has at least one internal passageway therethrough for the circulation of cooling fluid. Where the bonded busbar is connected by a jumper switch for current connection, the cooling passageway of the busbar may connect at the location of the jumper switch.

19 Claims, 3 Drawing Sheets

BONDED BUSBAR FOR DIAPHRAGM CELL CATHODE

BACKGROUND OF THE INVENTION

In the manufacture of chlor-alkali diaphragm cells, there have been developed cells which operate at high current capacities with correspondingly high production capacities. Typically, chlor-alkali diaphragm cells may now operate at current capacities of upwards to about 200,000 amperes, while maintaining desirable operating efficiencies. One such cell which has been developed for this more efficient operation comprises a novel cathode busbar structure. As shown in the U.S. Pat. Nos. 3,859,196 and 3,904,504 this novel cathode busbar structure comprises at least one lead-in busbar and a plurality of busbar strips which have different relative dimensions. This structure is attached to a sidewall of the cell whereby the sidewall plus busbar structure provides an at least partially cathode-walled enclosure.

Such chlor-alkali diaphragm cells which have been developed to operate at high current capacities can also require a high amperage switch apparatus. A suitable such apparatus has been disclosed in U.S. Pat. No. 3,778,680. Therein there is shown a switch apparatus particularly for high amperage electrical switching, which apparatus is resiliently mounted and has fluid-cooled terminals.

It would be desirable to combine the features of these developments to readily accommodate high amperage switch apparatus with a cathode busbar structure of a cathode-walled enclosure.

SUMMARY OF THE INVENTION

It has now been found possible to provide a most efficient cathode sidewall busbar structure. The structure is economically monolithic and unitary. The structure can be desirably compatible with present day high amperage switch apparatus. Such compatibility includes linkage of the switch apparatus cooling means with cooling means for the sidewall busbar.

In one broad aspect the invention relates to an electrolytic cell wherein the cell comprises a walled enclosure with there being at least one cathode sidewall for the enclosure, such cell having a cover over, and a cell bottom beneath, the walled enclosure, and with there being means for introducing current from outside the cell to a cathode sidewall through a busbar. In this context, the invention provides the improvement comprising a cathode busbar structure external to the cell, which structure has an at least substantially wall-sized sidewall busbar that is interface bonded to the cathode sidewall, whereby the cathode sidewall plus interface bonded sidewall busbar combine together to form at least substantially a wall unit for such cell, with the sidewall busbar having internal passageways for the circulation of cooling fluid therethrough.

In another aspect the invention is directed to a novel busbar for interface bonding to a cathode sidewall of an electrolytic diaphragm cell.

DESCRIPTION OF THE PREFERRED EMBODIMENTS

The invention relates generally to electrolytic cells suited for the electrolysis of aqueous alkali metal chloride solutions. The cells may be used for the production of chlorine, chlorates, chlorites, hydrochloric acid, caustic, hydrogen and related chemicals. For the sidewall of the cathode-walled enclosure it has been typical to use a conductive metal which has desirable strength and structural properties. Most always, the wall will be made of steel, e.g., cold-rolled, low carbon steel. For the cathode busbar structure the useful metals are those which are highly electrically conductive. Most always this metal will be copper, but there may also be used aluminum.

Figure 1:
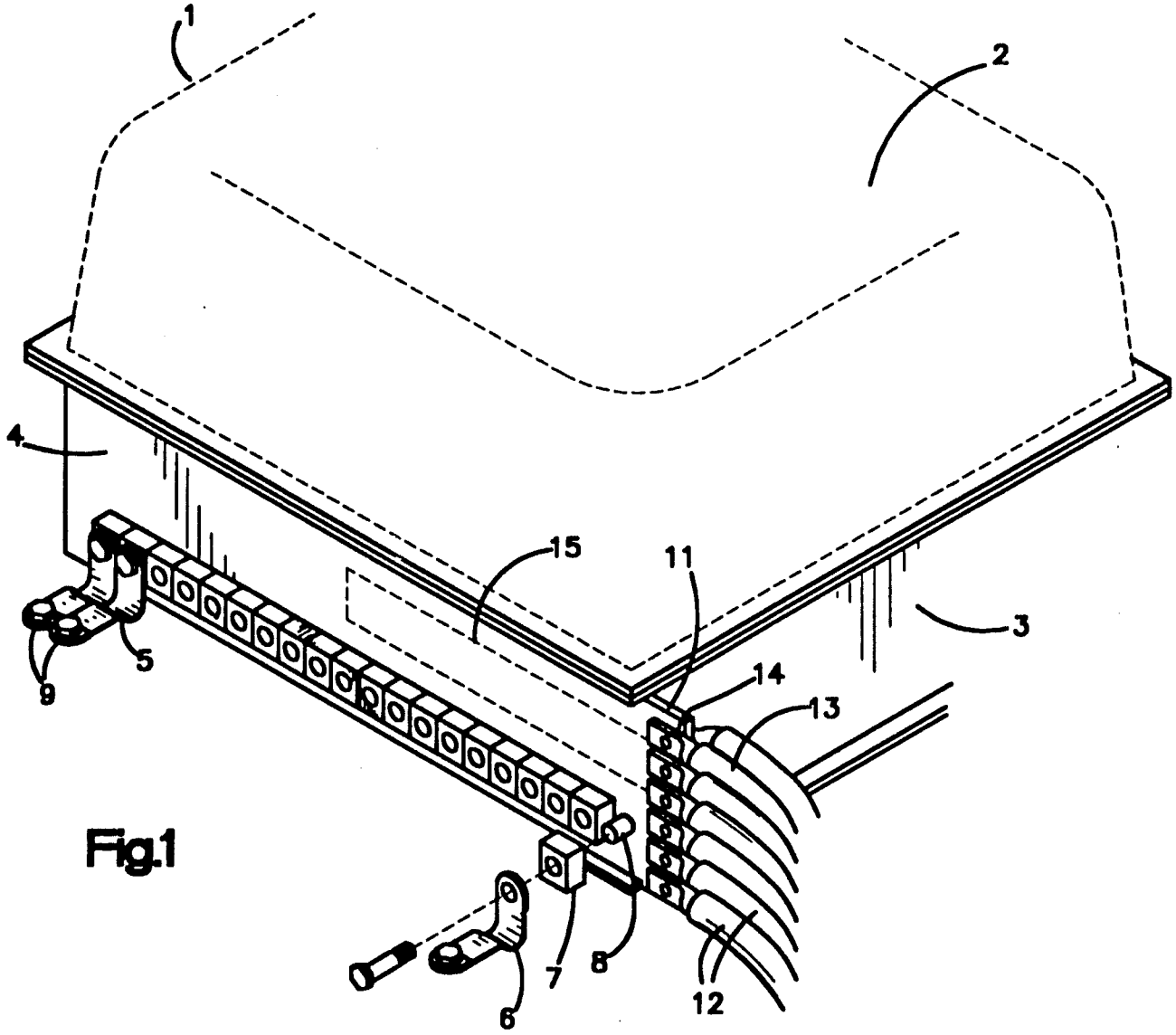
FIG. 1 is a perspective view of a typical electrolytic cell of the present invention.

Referring now more particularly to FIG. 1, a cell shown generally at 1 has a cover 2 and four sidewalls 3. The sidewall 3 in the foreground is positioned behind a sidewall busbar 4. The sidewall busbar 4 is connected by intercell connectors 5, only some of which are shown, to an adjacent cell, not shown. More particularly, each intercell connector 5 is connected to a spacer 7 which is fitted over a post 8. The connector 5 on the one end is secured to the post 8, and on the opposite end is secured by nuts 9 to the base of an adjacent cell, not shown.

These intercell connectors 5 are positioned across almost the complete length of the sidewall busbar 4, at the bottom. As is more particularly depicted in the figure, this sidewall busbar 4 can be a unitary, monolithic and planar busbar 4 that is, for the particular cell 1 of the figure, as high as the cell sidewall 3 and can be longer than the sidewall 3 to which it is bonded. The busbar 4 may thus be actually larger than the sidewall 3. But, in essence, the sidewall busbar 4 and its adjacent sidewall 3 together form one wall of the cell 1. The extra length of the sidewall busbar 4, extending beyond the intercell connectors 5, forms a sidewall busbar extension 11. To this sidewall busbar extension 11 there are attached cathode jumper switches or connectors 12. Each jumper connector 12 comprises a tubular conduit 13 and a lug 14 extending into connection with the sidewall busbar 4 at the sidewall busbar extension 11. Further, this sidewall busbar 4 contains a cooling conduit passageway 15, extending in a generally loop configuration and shown in phantom.

Figure 2:
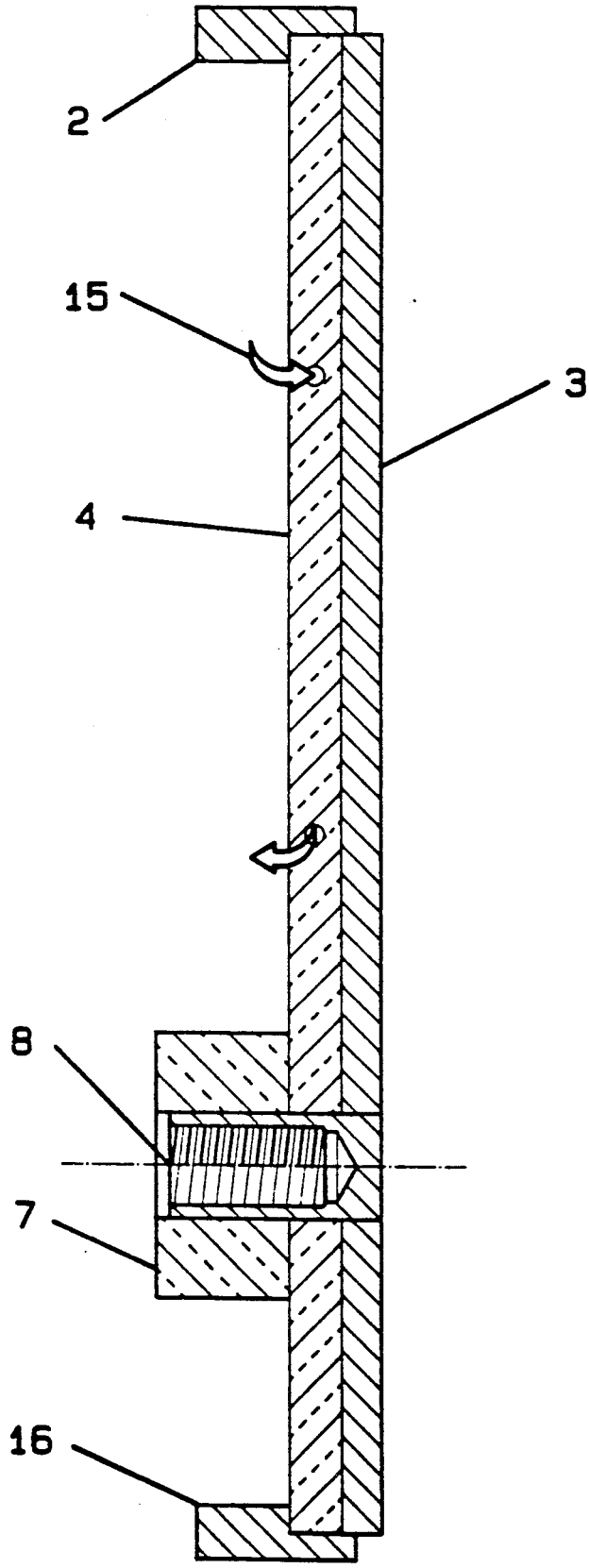
FIG. 2 is a side elevation, in section, of the cathode sidewall of FIG. 1.

Referring then to FIG. 2, there is shown the interface bonded structure of sidewall 3 and sidewall busbar 4. This bonded structure extends the full length from an edge of the cell cover 2 downwardly to a cell bottom 16. Connecting to the sidewall 3 and sidewall busbar 4 through a post 8 and spacer 7 is an intercell connector, not shown. Extending into the sidewall busbar 4 is a cooling conduit 15, the direction of the flow of coolant to and from the conduit 15 being shown by the arrows.

Figure 3:
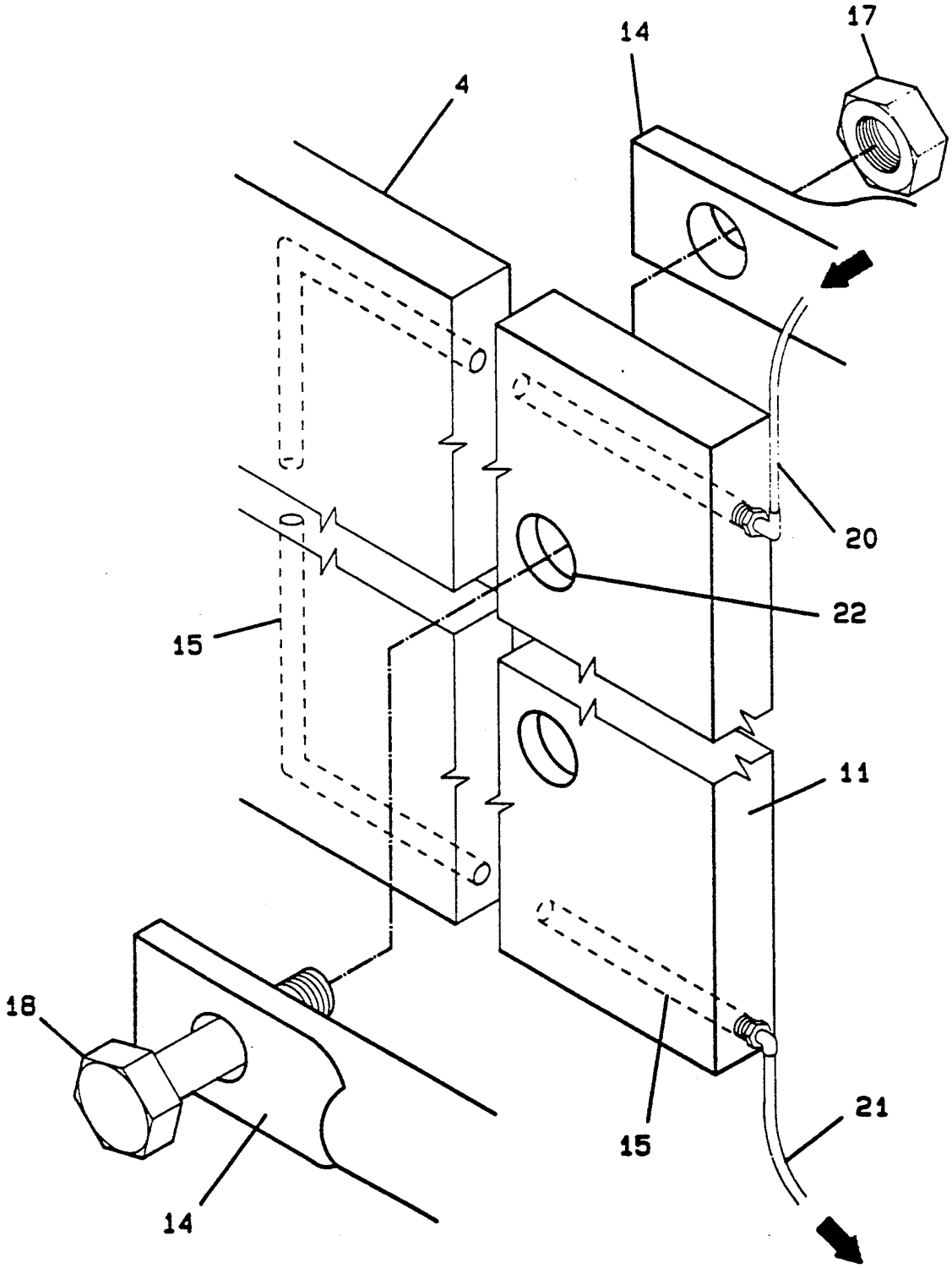
FIG. 3 is an exploded, perspective view of a portion of the sidewall busbar of the cell of FIG. 1, more particularly detailing, in partial section, electrical and coolant connections.

Referring then to FIG. 3, a sidewall busbar extension 11 extends beyond a busbar 4. Connecting to this sidewall busbar extension 11 are the cathode jumper connector lugs 14. As shown more particularly in this figure, a pair of jumper connector lugs 14 are secured to the sidewall busbar extension 11 by a nut 17 and bolt 18 which connect through an aperture 22 in the sidewall extension 11. There is then formed in the busbar 4 and sidewall busbar extension 11 a conduit passageway 15, generally concentric in cross section. Fluid cooling media, usually water, can be fed into this conduit passageway 15 by a coolant inlet feeder hose 20. After circulating in the busbar 4 and extension 11, coolant in the passageway 15 can flow out of the sidewall extension 11 through a coolant exit return hose 21. Cooling fluid can be supplied to the inlet feeder hose 20 from a cell room source, not shown, external to the cell.

By such means cooling fluid can be provided to the cathode busbar 4 when an adjacent electrolytic cell is jumpered. It is to be understood however that cooling means can be used during routine cell operation to cool the cathode busbar 4, although it is normally needed only during jumpering of the cell when the entire electrical current flows through the lugs 14 and busbar extension 11 to the cathode busbar 4.

In assembly, the cathode busbar 4, being typically a copper busbar 4, can be interface bonded to the cathode sidewall 3 such as by explosion bonding, brazing or roll bonding. Where the cathode busbar 4 is copper and the cathode sidewall 3 is steel it is preferred to use explosion bonding or brazing. Even though the sidewall busbar 4 can be a unitary, monolithic planar busbar 4, which even extends in length beyond the length of the sidewall 3 and which is usually of uniform thickness for its total length including the length beyond the sidewall 3, such busbar 4 can nevertheless be desirably interface bonded to the sidewall 3. Such bonding can provide for an integral electrical unit achieving desirable efficiency of cathode operation. It is also to be understood that the busbar extension 11 may be an attachment to the sidewall busbar 4. Such attachment can be by metallurgical means, e.g., welding, or by mechanical means such as bolting.

It is to be understood that the intercell connectors 5 including the spacers 7, and posts 8, will be made of any material of construction usually utilized for such items, e.g., copper. Furthermore, the cathode jumper connectors 12 will have electrically insulating tubular conduits 13, as well as lugs 14 as conventionally employed for such electrolytic cells, e.g., copper lugs 14. For cooling, the sidewall busbar cooling conduit passageway 15 may take any desired form for supplying cooling to the sidewall busbar 4. Usually such passageway 15 will be fashioned in the form of a loop originating in and exiting from, the sidewall busbar extension 11. Where the supply of cooling liquid is to be particularly utilized during jumpering, such a loop may extend partly, e.g., substantially halfway, along the length of the sidewall busbar 4, as more particularly depicted in FIG. 1. In any event, for most efficient cooling of the sidewall busbar 4 it is always contemplated that cooling fluid will be provided to and removed from the busbar 4 in the manner as shown in FIG. 3. This sidewall busbar passageway 15 is preferably obtained by rifle drilling, i.e., deep and narrow passage drilling performed with a lathe.

We claim:

1. In an electrolytic cell wherein the cell comprises a walled enclosure with there being at least one cathode sidewall for said enclosure, said cell having a cover over, and a cell bottom beneath, said walled enclosure, and with there being means for introducing current from outside the cell to a cathode sidewall through a busbar, the improvement comprising a cathode busbar structure external to said cell, which structure has a unitary, at least substantially rectangular-shaped and wall-sized, sidewall busbar comprised of a busbar section and an extension section, which extension section extends beyond the sidewall, which unitary at least substantially wall-sized sidebar busbar is interface bonded to said cathode sidewall, whereby said cathode sidewall plus interface bonded sidewall busbar combine together to form at least substantially a wall unit for said cell, with said sidewall busbar having at least one internal passageway for the circulation of cooling fluid therethrough with coolant flowing to said extension section and circulating in the extension section and the busbar section.

2. The cell of claim 1, wherein said cathode sidewall is a steel sidewall and said sidewall busbar is a copper or aluminum busbar.

3. The cell of claim 1, wherein said unitary sidewall busbar is a planar busbar which is interface bonded to said cathode sidewall by explosion bonding, brazing, or roll bonding.

4. The cell of claim 1, wherein said sidewall busbar is larger than said cathode sidewall, extending beyond the length of said sidewall, with the sidewall extension portion connecting to at least one jumper switch, and with an impressed current being supplied through said jumper switch to said busbar.

5. The cell of claim 4, wherein said sidewall busbar is a unitary, monolithic sidewall busbar and extends beyond the length of said sidewall.

6. The cell of claim 4, wherein said sidewall busbar is a wall-sized busbar having a busbar extension member secured thereto and extending beyond the length of said sidewall.

7. The cell of claim 4, wherein said sidewall busbar has at least one rifle drilled cooling fluid passageway therethrough.

8. The cell of claim 7, wherein said cooling fluid passageway extends beyond the length of said sidewall.

9. The cell of claim 7, wherein said cooling fluid passageway extends approximately one-half the length of said busbar from said jumper switch.

10. The cell of claim 1, wherein said sidewall busbar is connected by means of a spacer member to at least one intercell connector.

11. In an electrolytic cell wherein the cell comprises a walled enclosure with there being at least one cathode sidewall for said enclosure, said cell having a cover over, and a cell bottom beneath, said walled enclosure, and with there being means for introducing current from outside the cell to a cathode sidewall through a sidewall busbar comprised of a busbar section and an extension section, which extension section extends beyond the sidewall, the improvement comprising at least one jumper switch connected to said sidewall busbar at the extension section, at least one internal passageway within said busbar section, at least one internal passageway within said extension section and communicating with said internal passageway within said busbar section, and cooling fluid connection means connecting at said extension section, whereby coolant flows to said extension section from beyond said busbar and circulates in the extension section and the busbar section.

12. The cell of claim 11, wherein said sidewall busbar including said extension is sized larger than a cell sidewall.

13. The cell of claim 11, wherein said sidewall busbar is a planar busbar which is interface bonded to said cathode sidewall.

14. The cell of claim 11, wherein an impressed current is supplied through said jumper switch to said busbar.

15. The cell of claim 11, wherein said sidewall busbar is a unitary, monolithic sidewall busbar which extends beyond the length of said sidewall.

16. The cell of claim 11, wherein said sidewall busbar is an essentially wall-sized busbar and said busbar extension is a busbar member secured thereto.

17. The cell of claim 11, wherein said sidewall busbar has at least one rifle drilled cooling fluid passageway therethrough.

18. The cell of claim 11, wherein said cooling fluid passageway extends approximately one-half the length of said busbar from said jumper switch.

19. The cell of claim 11, wherein said sidewall busbar is connected by means of a spacer member to at least one intercell connector.

* * * * *